US008764379B2

(12) United States Patent
Pal

(10) Patent No.: US 8,764,379 B2
(45) Date of Patent: Jul. 1, 2014

(54) TURBINE BLADE WITH SHIELDED TIP COOLANT SUPPLY PASSAGEWAY

(75) Inventor: Dipankar Pal, Greenville, SC (US)

(73) Assignee: General Electric Company, Schenectady, NY (US)

( * ) Notice: Subject to any disclaimer, the term of this patent is extended or adjusted under 35 U.S.C. 154(b) by 518 days.

(21) Appl. No.: 12/712,509

(22) Filed: Feb. 25, 2010

(65) Prior Publication Data

US 2011/0206536 A1 Aug. 25, 2011

(51) Int. Cl.
*F01D 5/18* (2006.01)

(52) U.S. Cl.
USPC ..... 415/115

(58) Field of Classification Search
CPC ..... F01D 5/18; F01D 5/186; F01D 5/188; F05D 2260/202; F05D 2260/231; F05D 2260/205
USPC ..... 416/97 R
See application file for complete search history.

(56) References Cited

U.S. PATENT DOCUMENTS

| | | | | |
|---|---|---|---|---|
| 4,761,116 | A * | 8/1988 | Braddy et al. | 416/92 |
| 5,261,789 | A | 11/1993 | Butts et al. | |
| 5,482,435 | A * | 1/1996 | Dorris et al. | 416/97 R |
| 5,660,523 | A | 8/1997 | Lee | |
| 6,382,913 | B1 | 5/2002 | Lee et al. | |
| 6,481,967 | B2 * | 11/2002 | Tomita et al. | 416/97 R |
| 6,494,678 | B1 | 12/2002 | Bunker | |
| 6,508,620 | B2 * | 1/2003 | Sreekanth et al. | 415/115 |
| 7,097,419 | B2 * | 8/2006 | Lee et al. | 415/115 |
| 7,334,991 | B2 * | 2/2008 | Liang | 416/97 R |
| 7,413,403 | B2 | 8/2008 | Cunha et al. | |
| 7,648,334 | B2 * | 1/2010 | Hurst et al. | 415/115 |

* cited by examiner

*Primary Examiner* — Edward Look
*Assistant Examiner* — Jeffrey A Brownson
(74) *Attorney, Agent, or Firm* — Nixon & Vanderhye P.C.

(57) ABSTRACT

A turbine blade for a turbine engine includes main coolant passageways which extend through the turbine blade to cool the blade. A tip coolant passageway conveys coolant from a location adjacent the base of the blade directly to the tip of the blade to provide cooling fluid directly to the tip of the blade. This ensures that the coolant arriving at the tip of the blade is at a relatively low temperature and can therefore provide effective cooling of the material located at the tip of the blade.

13 Claims, 5 Drawing Sheets

TURBINE BLADE WITH SHIELDED TIP COOLANT SUPPLY PASSAGEWAY

BACKGROUND OF THE INVENTION

Turbine engines make use of turbine blades which are attached to the rotating shaft of the turbine. Hot combustion gases passing through the turbine section of a turbine engine impinge upon the turbine blades, which causes the blades and the attached shaft to rotate. Typically, a turbine engine will include multiple rows of blades mounted on the rotating shaft, as well as multiple rows of stationary blades. The rows of rotating and stationary blades alternate with one another.

Hot combustion gases which have passed by a row of rotating turbine blades then impinge upon the following row of stationary blades. The row of stationary blades re-direct the combustion gases before they arrive at the next row of the rotating turbine blades.

Both the rotating turbine blades and the stationary blades are subjected to an extremely harsh operating environment. The blades experience high temperatures, and the passage of extremely hot combustion gases at high velocities. To help the rotating and non-rotating blades within the turbine section cope with the harsh operating environment, it is common to form cooling passages within the blades themselves. The cooling passages are supplied with a coolant, typically in the form of cooled compressed air. The compressed air moves through the cooling passages within the blades to help cool the blades, and the coolant usually then exits the blades through multiple cooling holes formed on the exterior surface of the blades.

BRIEF DESCRIPTION OF THE INVENTION

In a first aspect, the invention may be embodied on a blade for use in a turbine, the blade including a blade body having a base and a tip. At least one serpentine coolant passage is located inside the blade body. A tip coolant passage is also located in the blade body, wherein the tip coolant passage runs directly from a location adjacent the base of the body to a location adjacent the tip of the body.

In another aspect, the invention may be embodied in a method of forming a blade for use in a turbine. The method includes forming a blade body having a base and a tip, forming at least one serpentine coolant passage inside the blade body, and forming a tip coolant passage inside the blade body, wherein the tip coolant passage runs directly from a location adjacent the base of the body to a location adjacent the tip of the body.

DETAILED DESCRIPTION OF THE INVENTION

Figure 1:
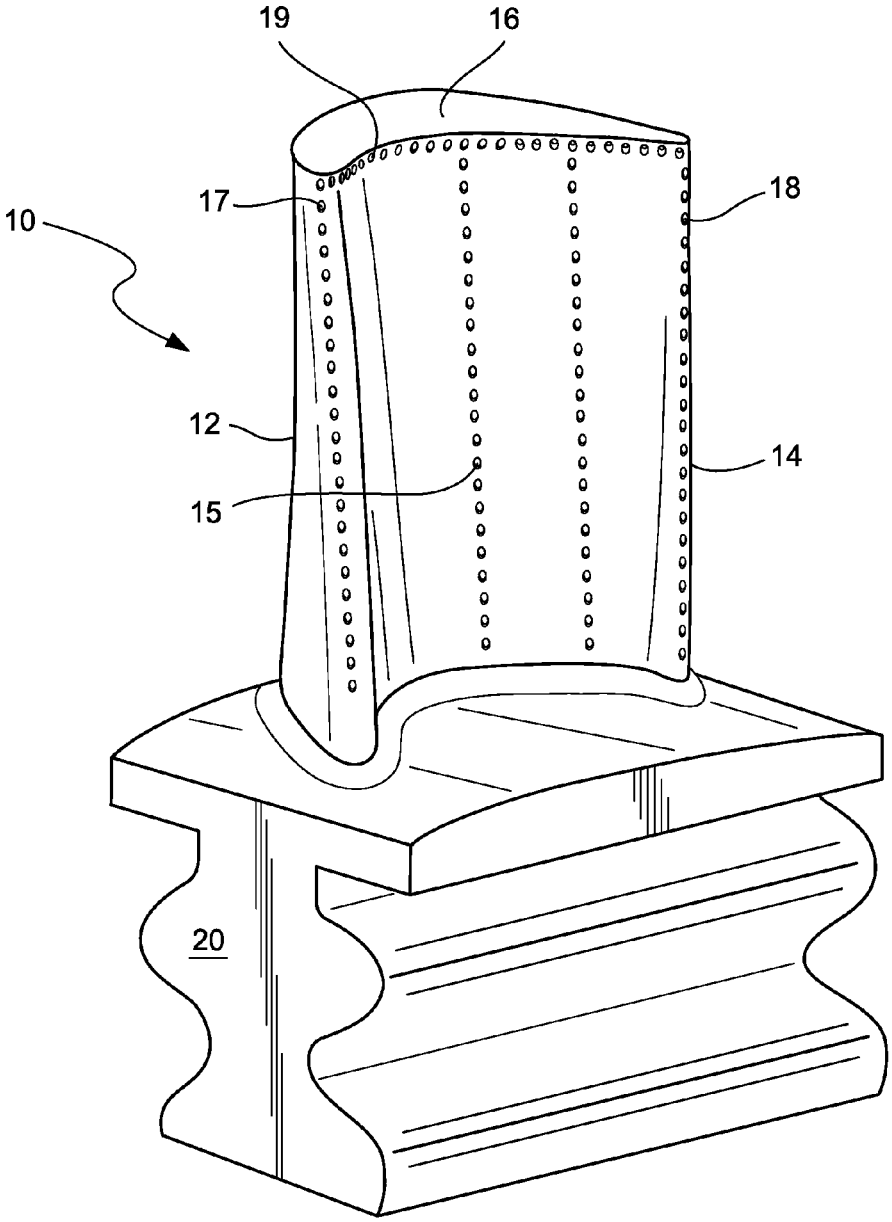
FIGURE 1 BACKGROUND ART
FIG. 1 is a perspective view of a turbine blade.

FIG. 1 shows a typical turbine blade on a mount 20. The embodiment shown in FIG. 1 is intended to represent a rotating turbine blade of a turbine. However, the invention is equally applicable to stationary turbine blades (stator vanes).

The turbine blade 10 includes a leading edge 12, a trailing edge 14, and a tip 16. A plurality of cooling holes are located over the surface of the blade. The cooling holes can include cooling holes 17 located adjacent the leading edge 12 of the blade, cooling holes 18 located adjacent the trailing edge 14 of the blade, and cooling holes 15 located along the mid portion of the blade. In addition, cooling holes 19 may be located along the tip portion of the blade. The configuration illustrated in FIG. 1 is intended to be illustrative only. The patterns and locations of the cooling holes can vary greatly from one turbine blade design to the next.

Figure 2:
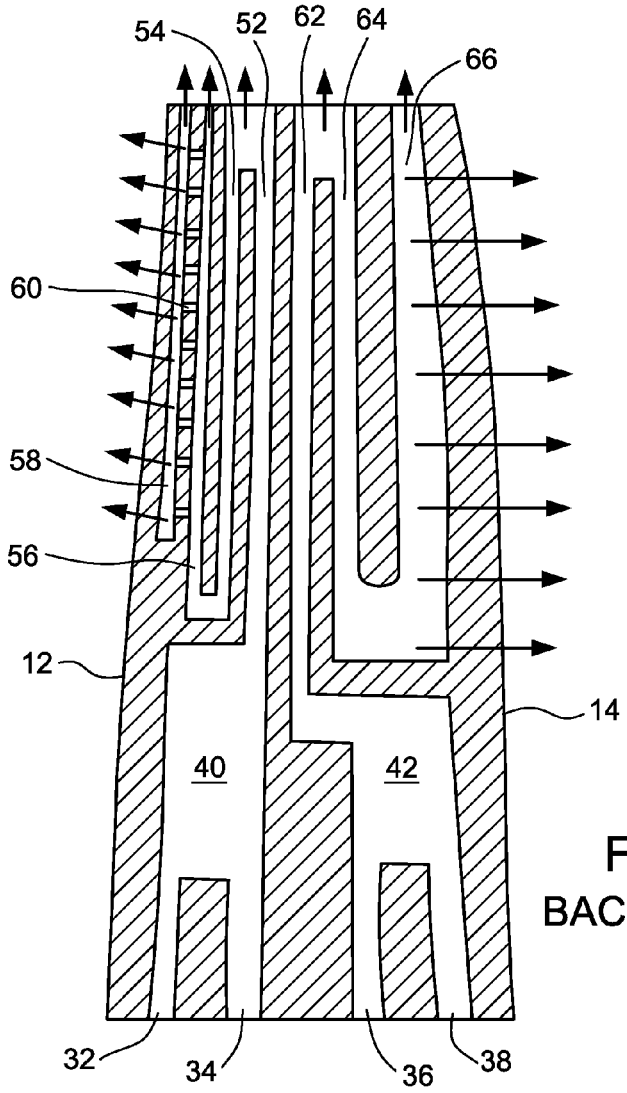
FIGURE 2 BACKGROUND ART
FIG. 2 is a longitudinal cross section of a turbine blade.

FIG. 2 shows a longitudinal cross section of a typical turbine blade which includes serpentine cooling passages. As shown in FIG. 2, the serpentine cooling passages receive a flow of coolant through four cooling inlets located on the base of the blade. The four cooling inlets include a first inlet 32, a second inlet 34, a third inlet 36, and a fourth inlet 38. Although this embodiment includes four coolant inlets, other embodiments of blades with serpentine cooling passages could have different numbers of inlets.

When the blade 10 is mounted onto an associated mount 20, as illustrated in FIG. 1, the first, second, third and fourth inlets 32, 34, 36, 38 in the blade body align with corresponding coolant outlets located on the base 20. This allows a flow of coolant to move from the base 20 into the interior of the blade body.

In the turbine blade illustrated in FIG. 2, two serpentine cooling passageways are formed to circulate a flow of coolant throughout the body of the blade. The first serpentine coolant passageway is located on the front or leading portion of the blade body. The first serpentine cooling passage receives a flow of coolant through the first inlet 32 and the second inlet 34. The coolant entering through the first and second inlets 32/34 is then received in a first collection chamber 40. The coolant then flows along a first upwardly extending passageway 52 toward the tip portion of the blade. At the top of the blade, the coolant flow turns 180° and flows downward through a second and downwardly extending passageway 54. At the bottom of the second downwardly passageway 54, the coolant again turns 180° and begins to move back up the blade through a third upwardly extending passageway 56. The coolant in the third upwardly passageway 56 can then cross over into a fourth upwardly extending passageway 58 through a plurality of cross-over holes 60 formed between the third and fourth passageways.

Coolant located in the fourth upwardly extending passageway 58 can then escape through a plurality of cooling holes located adjacent the leading edge 12 of the blade body. In addition, coolant in the first, second, third and fourth passageways could be exiting through the side surface of the blade through cooling holes formed along the mid portion of the blade body. In addition, coolant from the passageways could also be escaping through coolant outlets located along the tip of the blade.

A second serpentine coolant passageway is formed along the trailing half of the blade, the second serpentine cooling passageway receives coolant from the third inlet 36 and the fourth inlet 38. The coolant entering through the third and fourth inlets is received in a receiving chamber 42. The coolant then flows through a first upwardly extending passageway 62 towards the tip of the blade. Near the tip, the coolant flow turns 180° and begins to move downward through a second cooling passageway 64. Coolant in the second passageway 64 reaches the bottom of that passageway and then turns 180° and begins to rise upward along a third upwardly extending coolant passageway 66. As with the first serpentine passageway, coolant can be escaping through the first second and third passageways via cooling holes formed on the surfaces of the blade. In addition, coolant would typically escape through cooling holes located adjacent the trailing edge of the blade from the third coolant passageway 66. Further, coolant may escape through coolant holes located along the tip of the blade from one or more of the first passageway 62, second passageways 64 or third passageway 66.

Figure 3:
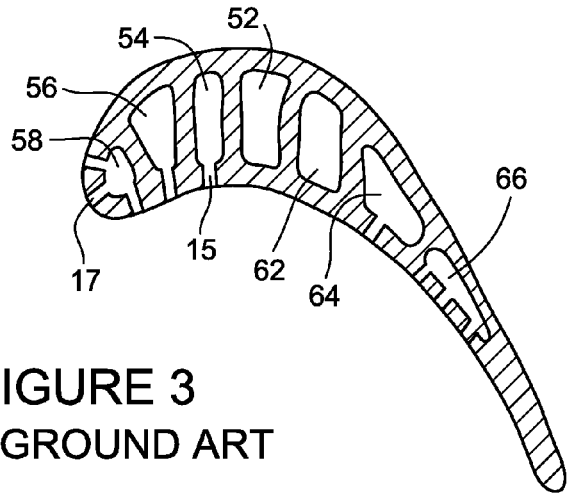
FIGURE 3 BACKGROUND ART
FIG. 3 is a transverse cross sectional view of the turbine blade illustrated in FIG. 2.

A transverse cross sectional view of this turbine blade is illustrated in FIG. 3. As shown therein, coolant holes 15 along the mid-portion of the blade can allow coolant to escape from, for instance, the second downwardly extending coolant passageway 54 of the first serpentine coolant passage. Likewise, coolant could exit from coolant holes 17 located adjacent the leading edge of the blade through the fourth coolant passageway 58 of the first serpentine passageway.

With a turbine blade as illustrated in FIGS. 2 and 3, coolant which reaches the tip of the blade has typically already passed through one or more of the upwardly and downwardly extending passageways of the first and second serpentine coolant passageways. As a result, by the time the coolant reaches the tip of the blade, the coolant may have already been heated to a very hot temperature. This makes cooling the material at the tip of the blade more difficult. In some designs, the coolant will not reach the tip of the blade until it has already passed through multiple runs of a serpentine coolant passageway. As a result, cooling at the tip of the blade is impaired, and the material tends to maintain an temperature that is hotter than desirable.

Likewise, the same drawbacks can exist for stator blades of a turbine engine. In some instances, the stator vanes also incorporate serpentine cooling passageways. And in those instances, the coolant may make more than one pass along the length of the stator vane before arriving at a particular portion of the stator vane, which can lead to those portions of the stator vanes being hotter than desired.

Figure 4:
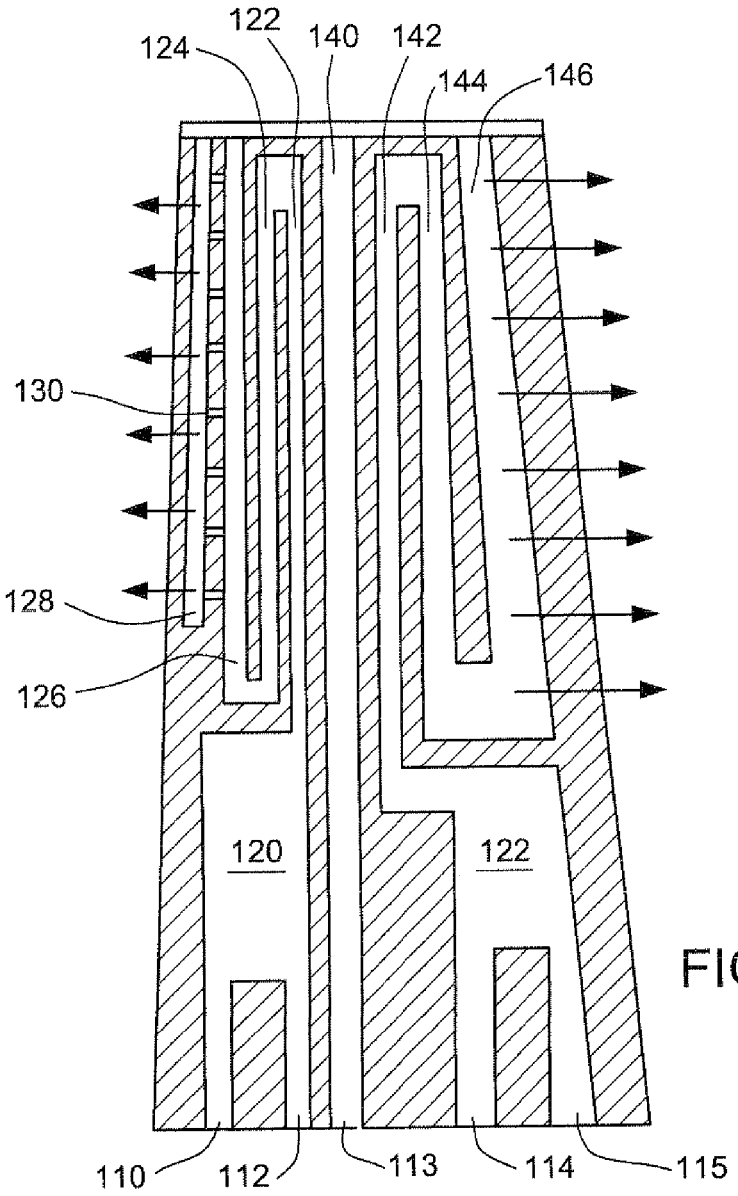
FIG. 4 is a longitudinal cross sectional view of another turbine blade.
Figure 5:
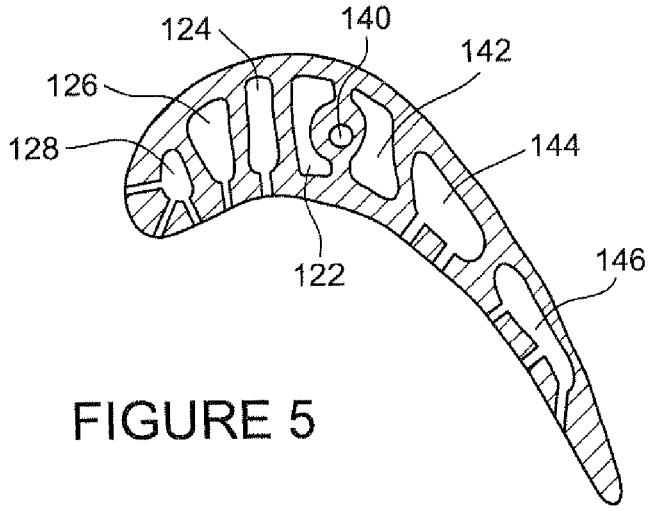
FIG. 5 is a transverse cross sectional view of the turbine blade illustrated in FIG. 4.

FIGS. 4 and 5 illustrate an alternate way of arranging the coolant passageways within a turbine blade. In the embodiment illustrated in FIGS. 4 and 5, a separate coolant passageway is dedicated to feeding coolant directly from the base of the turbine blade to the tip of the turbine blade. The coolant arriving at the tip through this dedicated passageway will not have passed through multiple serpentine coolant passageways before arriving at the tip. In addition, the coolant moving through the separate coolant passageway is partially shielded from the hot surrounding portions of the blade. As a result of these factors, the temperature of the coolant received at the tip is considerably lower than if the coolant has first made multiple passes through an unshielded serpentine passageway. This makes it possible to more effectively cool the material at the tip.

As illustrated in FIGS. 4 and 5, the first and second serpentine passages still exist. The first serpentine passage receives a flow of coolant from a first inlet 110 and a second inlet 112. The cooling passes into a first receiving chamber 120, and then enters the additional passageways making up the first serpentine coolant passageway. This includes a first upwardly extending passageway 122, a second downwardly extending passageway 124, and two upwardly extending passageways 126 and 128 which are joined by multiple cross-over holes 130. As with the embodiment described with respect to FIGS. 2 and 3, coolant may be exit from any one or more of these passageways through coolant holes located on the surface of the turbine blade.

As also illustrated in FIG. 4, the second serpentine passageway receives a flow of coolant from a third inlet 114 and a fourth inlet 115. This coolant is received in a chamber 122 and the coolant then moves into a first upwardly extending passageway 142. The coolant passes on to a second downwardly extending passageway 144 and then into a third upwardly extending passageway 146.

In this design, coolant in the first and second serpentine passageways is fed to cooling holes on all portions of the blade body except those at the tip of the blade. Instead, a completely separate tip coolant passageway 140 is located at approximately the center of the blade body. The tip coolant passageway 140 is fed with coolant through a fifth cooling inlet 113 located on the base of the blade. The coolant passes directly from the fifth inlet 113 to the top of the blade through the tip coolant passageway 140.

As illustrated in FIG. 5, the tip coolant passageway 140 can be located between the first upwardly extending passageways 122, 142 of the first and second serpentine coolant passageways. This can be achieved by slightly modifying the shape of the walls of the first upwardly extending passageways 122, 142, as compared to the embodiment illustrated in FIGS. 2 and 3. When the tip coolant passageway 140 is formed in this fashion, it also serves to shield the coolant in the tip coolant passageway 140 from the hot material of the blade body because the sides of the tip coolant passageway 140 are partially surrounded by the coolant in the surrounding serpentine passages.

Figure 6:
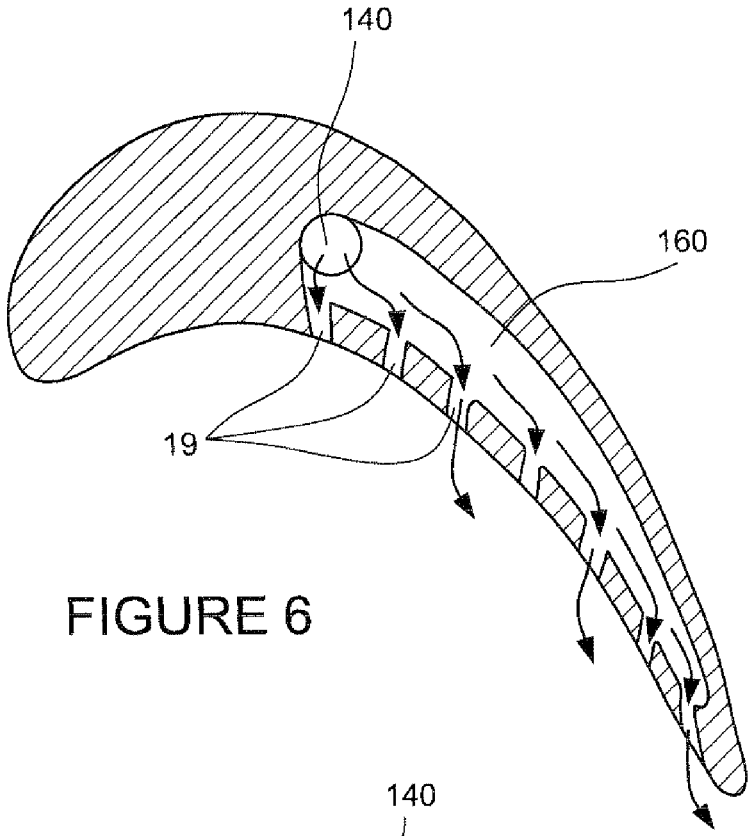
FIG. 6 is a transverse cross sectional view of the tip portion of a turbine blade.
Figure 7:
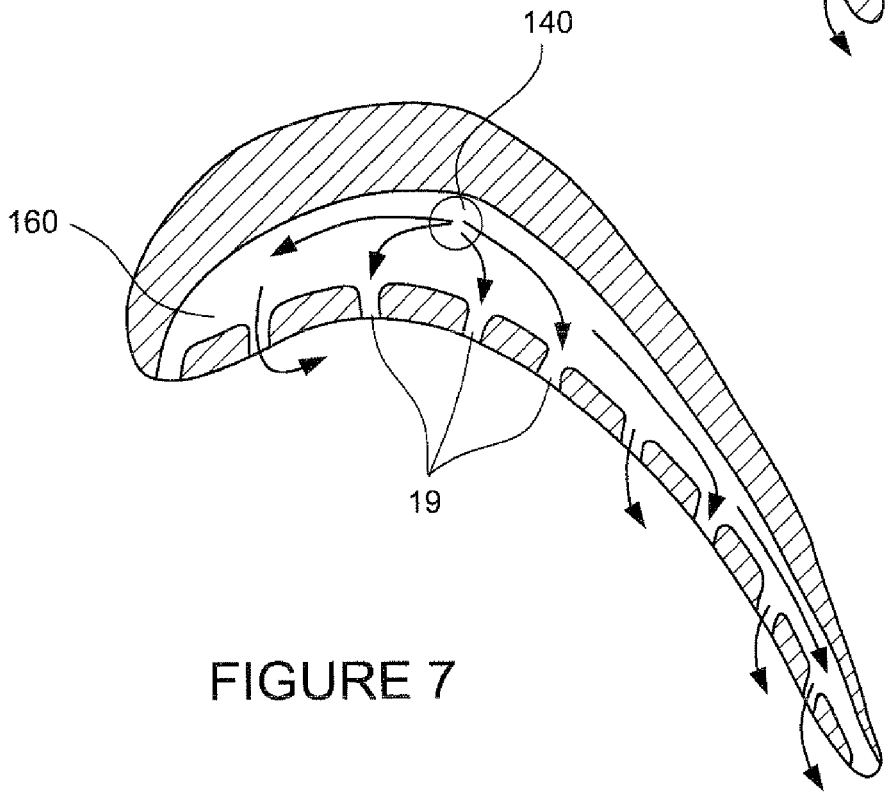
FIG. 7 is a transverse cross sectional view of the tip portion of another embodiment of a turbine blade.

FIGS. 6 and 7 illustrate two different embodiments of the tip portion of a blade which includes a separate tip coolant passageway. In the embodiment illustrated in FIG. 6, a tip coolant reservoir 160 is formed on the trailing half of the tip of the blade body. The tip coolant reservoir 160 receives coolant from the tip coolant passageway 140. The coolant is then expelled through multiple tip cooling holes 19 formed along the trailing half of the blade.

FIG. 7 illustrates another embodiment, however in this embodiment the tip coolant reservoir 160 also feeds the coolant received through the tip coolant passageway 140 to tip cooling holes 19 formed along the entire length of the tip of the blade.

In alternate embodiments, the tip coolant reservoir 160 could feed coolant to tip cooling holes located along additional portions of the leading and trailing edges of the blade, as well as to coolant holes located on the low pressure side of the blade body.

In yet additional embodiments, the coolant in the tip coolant reservoir 160 might be fed down into the last portions of the serpentine passageways that are located along the leading and trailing edges of the blade. For instance, and with reference to FIGS. 4 and 5, coolant in the tip coolant reservoir 160 might feed down into the second upwardly extending passage 128 at the leading edge and/or into the second upwardly extending passage 146 at the trailing edge. Because these passages 128/146 currently only receive coolant after it has traversed multiple passes of a serpentine passageway, operating in this fashion would help to supply coolant having a lower temperature to those portions of the blade body.

In the embodiment illustrated in FIGS. 4 and 5, the tip coolant passageway 140 received a flow of coolant through a fifth inlet 113 located at the base of the blade body. This embodiment might require a modification to the base that holds the blade body so that the base can feed coolant to a new fifth coolant inlet in the blade body. While this embodiment may have advantages because it ensures that coolant received from the base is conveyed directly to the tip of the blade body, this could also require a modification to the base which holds the blade body.

Figure 8:
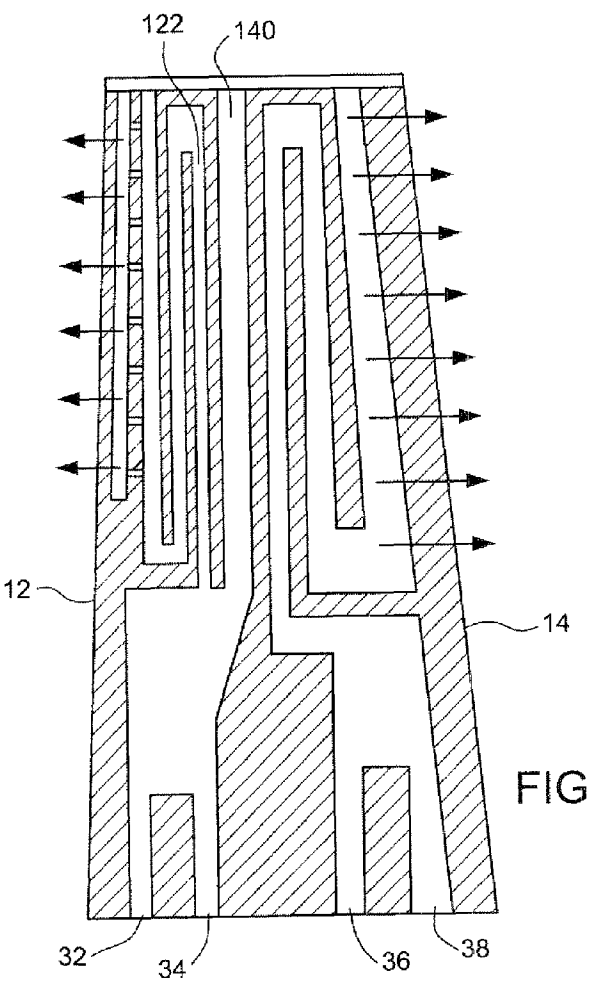
FIG. 8 is a longitudinal cross sectional view of another embodiment of a turbine blade.

FIG. 8 illustrates an embodiment of a blade body which includes a tip coolant passageway, but which does not require any modifications to the base which holds the blade body. In this embodiment, the first serpentine cooling passageway would still receive coolant from a first coolant inlet 32 and a second coolant inlet 34. However, the coolant received from the first and second coolant inlets would then be fed into both the first serpentine passageway formed along the leading half of the blade body as well as to the tip coolant passageway 140. Thus, it would not be necessary to modify the base to include a fifth coolant inlet.

Figure 9:
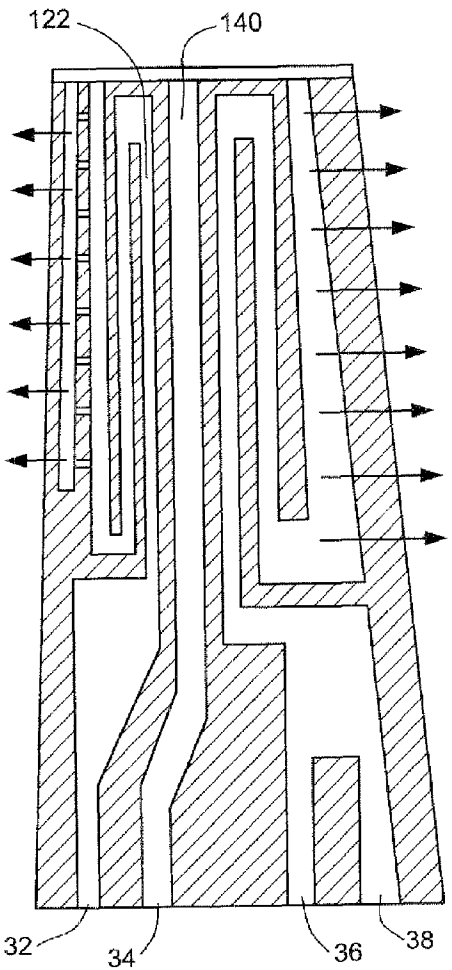
FIG. 9 is a longitudinal cross sectional view of another embodiment of a turbine blade.

FIG. 9 illustrates another embodiment of a turbine blade which would not require modification of the base. In this embodiment, the tip coolant passageway 140 is directly connected to the second coolant inlet 34. Thus, the first serpentine cooling circuit would then only be fed coolant from the first coolant inlet 32.

In alternate embodiments, the tip coolant passageway 140 also could be fed coolant by both the third and fourth coolant inlets 36, 38. Alternatively, the tip coolant passageway 140 could be fed by the third coolant inlet 36, and a fourth coolant inlet 38 could be used to supply coolant to only the second serpentine cooling passageway on the trailing half of the blade. Of course various other combinations would also be possible.

As noted above, providing a separate tip coolant passageway that leads directly from the base to the tip of a blade ensures that the coolant received at the tip arrives at relatively low temperature so that the coolant can provide effective cooling of the material at the tip of the blade.

In addition, with a structure as illustrated in FIG. 5, where the tip coolant passageway 140 runs up approximately the center of the thickness of the blade, and where the tip coolant passageway 140 is sandwiched between the serpentine cooling passages, there is likely to be less of a thermal gradient across the blade, as compared to an embodiment illustrated in FIG. 3. The tip coolant passageway 140 is partially shielded from direct heat transfer from the sides of the blade body. The lesser thermal gradient across the thickness of the blade may also help to increase the reliability and longevity of the turbine blades.

As noted above, providing a dedicated tip coolant passageway from a position adjacent the base of the blade directly to the tip of the blade could be done with both rotating turbine blades and non-rotating (stator) blades. The advantages provided by the dedicated tip coolant passageway are equally applicable to either type of blade.

In the embodiments described above, the tip coolant passageways are primarily located at the center of the thickness of the blade. In addition, the tip coolant passageway was located at a portion of a blade body which is approximately halfway between the leading and trailing edges of the blade. In alternate embodiments, the tip coolant passageway could be located at other locations. The embodiments illustrated in FIGS. 3A-7 are intended to be illustrative only and not limiting with respect to the location of the tip coolant passageway.

Moreover, the description provided above describes a blade body which includes four coolant inlets. In alternate embodiments, a blade body might include only a single coolant inlet, or any number of coolant inlets. Turbine blades embodying the invention and including a dedicated tip coolant passageway could utilize coolant from either one or multiple coolant inlets located at the base on the blade body.

Also, in the foregoing description, the main coolant passageways of the blades are serpentine passageways. However, the invention is equally applicable to blades that have other types of main coolant passageways. For instance, the invention is equally applicable to blades that are peripherally cooled.

In a peripherally cooled blade, there are typically multiple coolant passageways that run from the base of the blade up to the tip of the blade. The coolant passageways basically run straight upward for the full height of the blade. As a result, by the time any coolant reaches the tip of the blade, the coolant has already been heated during the passage up the blade.

If a separate tip coolant passageway is provided within a peripherally cooled blade, and the tip coolant passageway is thermally shielded during its passage up the height of the blade, the coolant reaching the tip through the tip coolant passageway will be considerably cooler than the coolant that reaches the tip through the normal coolant passageways. Thus, a peripherally cooled blade can also benefit from a separate tip coolant passageway.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade for use in a turbine, comprising:

a blade body having a base and a tip;

a first main coolant passageway located along a leading edge portion of the body;

a second main coolant passageway located along a trailing edge portion of the body; and a tip coolant passageway located between the first and second main coolant passageways in the blade body, wherein the tip coolant passageway runs from a location adjacent the base of the body to a location adjacent the tip of the body such that the tip coolant passageway delivers coolant only to the tip of the body, wherein the tip coolant passageway is enclosed by a sidewall having inner and outer surfaces and that extends the entire length of the tip coolant passageway, wherein an outer surface of the sidewall also forms an inner surface of a portion of at least one of the first and second main coolant passageways, wherein the sidewall thermally insulates coolant in the tip coolant passageway from coolant in at least one of first and second main coolant passageways, and wherein at least one web extends from the outer surface of the sidewall to an inner side of an outer wall of the blade body.

2. The blade of claim 1, further comprising a tip coolant reservoir located at the tip of the body, wherein the tip coolant passageway opens into the tip coolant reservoir.

3. The blade of claim 2, further comprising a plurality of tip coolant holes located on a surface of the blade adjacent the tip, wherein each of the tip coolant holes communicate with the tip coolant reservoir so that coolant in the tip coolant reservoir can escape the body through the tip coolant holes.

4. The blade of claim 1, wherein the body has a height, a width and a thickness, wherein the tip coolant passageway extends in the height direction, and wherein a longitudinal axis of the tip coolant passageway is located at approximately a middle of a thickness of the body.

5. The blade of claim 4, wherein the tip coolant passageway is located along approximately the thickest portion of the body.

6. The blade of claim 1, further comprising a coolant inlet located at the base of the body, wherein the coolant inlet receives coolant from a mounting portion that holds the body, and wherein coolant received through the coolant inlet is fed to the tip coolant passageway.

7. The blade of claim 1, further comprising first and second coolant inlets located at the base of the body, wherein the first and second coolant inlets both receive coolant from a mounting portion that holds the body, wherein coolant received through the first coolant inlet is fed into at least one of the first and second main coolant passageways, and wherein coolant received through the second coolant inlet is fed into the tip coolant passageway.

8. The blade of claim 1, wherein the first and second main coolant passageways comprise first and second serpentine coolant passageways, and further comprising first and second coolant inlets located at the base of the body, wherein the first and second coolant inlets both receive coolant from a mounting portion that holds the body, wherein coolant received through the first coolant inlet is fed into the first serpentine coolant passageway, and wherein coolant received through the second coolant inlet is fed into the second serpentine coolant passageway.

9. The blade of claim 8, further comprising a third coolant inlet, wherein the tip coolant passageway receives coolant from the third coolant inlet.

10. The blade of claim 1, wherein the blade is a rotating blade of a turbine.

11. The blade of claim 1, wherein the blade is a stationary blade of a turbine.

12. The blade of claim 1, wherein the sidewall that surrounds the tip coolant passageway is generally cylindrical.

13. The blade of claim 1, wherein the at least one web comprises first and second webs that extend, respectively, from first and second opposite sides of the outer surface of the sidewall to inner sides of first and second outer walls of the blade body.

* * * * *